United States Patent [19]

Naramore

[11] 4,147,342

[45] Apr. 3, 1979

[54] VIBRATING TAMPER

[75] Inventor: Raymond A. Naramore, Penfield, N.Y.

[73] Assignee: Xerox Corporation, Stamford, Conn.

[21] Appl. No.: 817,639

[22] Filed: Jul. 21, 1977

[51] Int. Cl.[2] ..... B65H 31/36
[52] U.S. Cl. ..... 271/221
[58] Field of Search ..... 271/221, 222

[56] References Cited

U.S. PATENT DOCUMENTS

| | | | |
|---|---|---|---|
| 2,992,823 | 7/1961 | Forrester | 271/222 |
| 3,370,848 | 2/1968 | Bartlett | 271/222 X |
| 3,713,651 | 1/1973 | Abler | 271/221 |

*Primary Examiner*—Richard A. Schacher

[57] ABSTRACT

Sheet alignment apparatus which registers a stack of sheets accurately and rapidly in a tray. A vibrating tamper member is moved into and out of contact with a stack of sheets urging the stack against a stop member momentarily before being withdrawn from the stack to effect alignment of the edges of the stack.

4 Claims, 2 Drawing Figures

VIBRATING TAMPER

This invention relates to an improved sheet alignment apparatus of the type associated with bins from a sorter device or the like where it is desirable to register individual sets of a copy stack.

In the field of stacking paper as for example in the copy output devices which receive copy sets from copy producing machines, printing presses and the like, it is necessary to insure that a stack of sheets is accurately registered for subsequent operation such as binding, trimming, etc. One such copying machine in which copy sets received from a copying machine are sorted into collated sets and then removed from the sorter trays for the binding operation is described in U.S. Pat. No. 3,995,748.

A common technique for aligning sheets in a stack is to subject the stack to an oscillatory motion by vibrating a plate or paddle as described, for example, in U.S. Pat. No. 3,982,751. A plurality of panels are positioned on the sides of the stack and vibrated back and forth as the sheets are received in the stack. Still another approach in the alignment of edges for a stack of sheets is the use of an oscillating motion in combination with low pressure air which is blown between the individual sheets so as to separate them from one another and facilitate their independent movement toward an abutment as described, for example, in U.S. Pat. No. 3,945,095.

The above described apparatus for alignment of sheets in a stack has not been entirely satisfactory from the standpoint that they are considerably prolix or noisy or otherwise undesirable for routine operation.

It is therefore a general object of the present invention to improve the alignment of edges of stacked sheets.

It is a further object of the invention to achieve proper registration of sheets simply and reliably.

It is still another object of the present invention to insure that copy sheets received in a tray or bin do not rebound.

Figure 1:
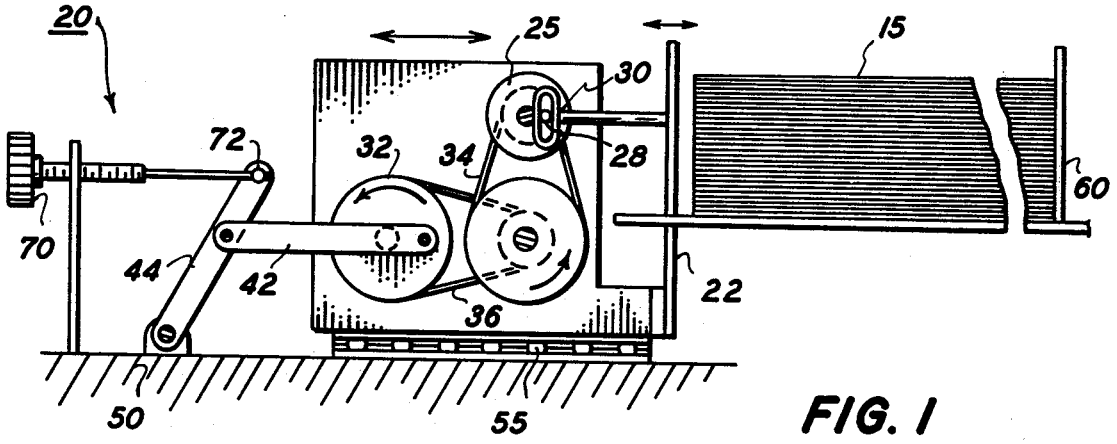
Figure 2:
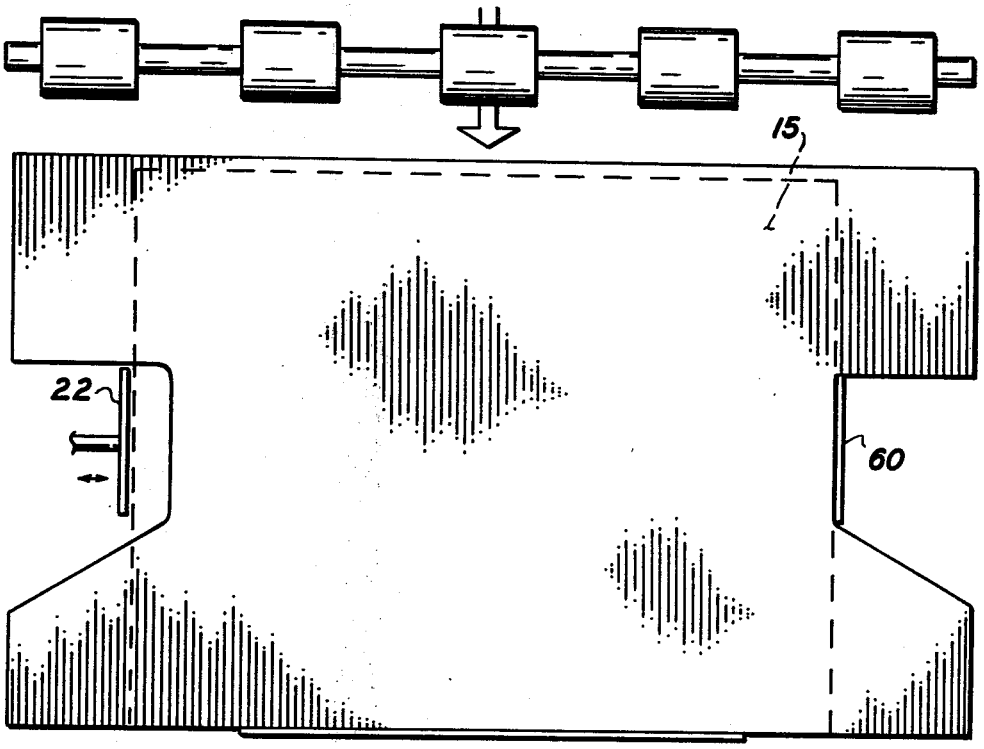

Other objects and advantages will become apparent from the ensuing description and drawing in which:

FIG. 1 is a side view of the sheet alignment apparatus according to the present invention; and FIG. 2 is a plan view of the stack of sheets and tamper member.

In accordance with the present invention, the registration or alignment of the edges of sheets 15 is achieved by a stack alignment apparatus 20. Referring to FIG. 1, stack alignment apparatus 20 includes a tamper member 22 which extends vertically along the one side of a stack of sheets 15 and horizontally for a short distance only from about 1 to about 3 inches. Tamper member 22 is positioned at approximately the horizontal centerline of the stack of sheets as best shown in FIG. 2.

In operation, tamper member 22 is pushed against the stack while being vibrated at a high frequency. It has been found that frequencies ranging from about 50 to about 70 oscillations or cycles per second work well. The pushing and vibration action is accomplished by a motor 25 which rotates a pin 28 to oscillate tamper member 22 through a scotch yolk 30. At the same time motor 25 drives a crank wheel 32 through belts 34 and 36 to impart a linear movement to tamper 22 via links 42 and 44. Thus, the drive motor 25 and tamper member slide relative to the frame 50 on balls 55.

Positioned on the opposite side of the stack of sheets 15 from the tamper member 22 is a stop member 60 which is for the purpose of abutting sheet edges as the oscillating tamper member 22 moves towards the stop member urging the sheet edges against the stop member momentarily before returning to its starting position. The crank motion of the sheet alignment apparatus can be adjusted for different size sheets by turning a thumb wheel 70 which is connected to an adjustable pivot 72 of link 44.

It will now be appreciated that due to the cranking motion and vibrating motion of the tamper member that the edges of the stack of sheets 15 are aligned accurately and rapidly. Thus, for example, in the case of a moving bin sorter carrying copy sets in trays as described in U.S. Pat. No. 3,995,748 the trays can be moved past the sheet alignment apparatus of the invention to effect proper registration of the sheet edges in each tray.

It will be further appreciated that more than one sheet alignment apparatus could be used for aligning the edges of a stack of sheets. Thus, one apparatus could align edges in one direction while another apparatus could align edges in a second direction of right angles to the first direction.

In accordance with the above-described sheet alignment apparatus, there is a positive proper stacking and registration of incoming sheets received in a stack. As a result the sheets are accurately aligned for subsequent operation on the stack as for example in a finishing operation, such as stapling, binding, etc.

While the invention has been described with the structure disclosed, it is not confined to the details set forth but is intended to cover such modifications or changes as may come within the scope of the following claims.

What is claimed is:

1. Apparatus for aligning the edges of the stack of sheets comprising:

tray means for supporting a stack of sheets fed one at a time to said tray means, stop means positioned on said tray means spaced from said stack, tamper means movable from a first position out of contact with said stack to a second position in contact with said stack urging said stack against said stop means, means for vibrating said tamper means at a predetermined frequency as said tamper means is being moved to said second position, drive means for moving said tamper means from said first position to said second position and then returning said tamper means to said first position whereby the sheet edges between said tamper means and said stop means are thereby aligned.

2. Apparatus according to claim 1 wherein said vibrating means operates at a frequency from about 50 to about 70 cycles per second.

3. Apparatus according to claim 1 wherein said drive means includes a crank wheel for imparting a cranking movement to said tamper means.

4. Apparatus according to claim 2 including means to adjust the distance of the cranking movement to accommodate different size sheets.

* * * * *